US009658571B2

(12) United States Patent
Kim et al.

(10) Patent No.: US 9,658,571 B2
(45) Date of Patent: May 23, 2017

(54) DEVELOPING DEVICE AND IMAGE FORMING APPARATUS INCLUDING THE SAME

(71) Applicant: SAMSUNG ELECTRONICS CO., LTD., Suwon-si, Gyeonggi-do (KR)

(72) Inventors: Jong-in Kim, Suwon-si (KR); Dong-uk Kim, Suwon-si (KR); Seung-gweon Lee, Suwon-si (KR); Woong-yong Choi, Yongin-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 11 days.

(21) Appl. No.: 14/690,974

(22) Filed: Apr. 20, 2015

(65) Prior Publication Data

US 2016/0103403 A1 Apr. 14, 2016

(30) Foreign Application Priority Data

Oct. 14, 2014 (KR) ..... 10-2014-0138609

(51) Int. Cl.
*G03G 15/08* (2006.01)

(52) U.S. Cl.
CPC ..... *G03G 15/0889* (2013.01); *G03G 15/0808* (2013.01); *G03G 15/0893* (2013.01)

(58) Field of Classification Search
USPC ..... 399/254, 256, 263
See application file for complete search history.

(56) References Cited

U.S. PATENT DOCUMENTS

| | | | | |
|---|---|---|---|---|
| 7,860,437 | B2 * | 12/2010 | Kakuta | G03G 15/0875 399/254 |
| 8,139,990 | B2 | 3/2012 | Okada et al. | |
| 2013/0279941 | A1 * | 10/2013 | Poterjoy | G03G 15/0889 399/254 |
| 2014/0056620 | A1 * | 2/2014 | Hashimoto | G03G 15/0839 399/254 |

FOREIGN PATENT DOCUMENTS

| | | |
|---|---|---|
| JP | 2007-041327 | 2/2007 |
| JP | 2008-191560 | 8/2008 |
| JP | 2009-300511 | 12/2009 |

* cited by examiner

*Primary Examiner* — Minh Phan
(74) *Attorney, Agent, or Firm* — Staas & Halsey LLP

(57) ABSTRACT

A developing device includes: a photosensitive body on which an electrostatic latent image is formed; a development chamber; a development roller that faces the photosensitive body and transfers toner to the electrostatic latent image; a supply roller that supplies toner from the development chamber to the development roller; and an agitating member that is disposed under the supply roller in the development chamber and agitates the toner that is in the development chamber.

18 Claims, 8 Drawing Sheets

DEVELOPING DEVICE AND IMAGE FORMING APPARATUS INCLUDING THE SAME

RELATED APPLICATION

This application claims the benefit under 35 U.S.C. §119 of Korean Patent Application No. 10-2014-0138609, filed Oct. 14, 2014, in the Korean Intellectual Property Office, the disclosure of which is incorporated herein by reference in its entirety.

BACKGROUND

1. Field

One or more example embodiments relate to a developing device that develops an electrostatic latent image and thereby produces a visible toner image, and an image forming apparatus including the developing device.

2. Description of the Related Art

An electrophotographic image forming apparatus forms an image on a recording medium by emitting light, which is modulated to correspond to image information, toward a photosensitive body to form an electrostatic latent image on a surface of the photosensitive body, supplying toner to the electrostatic latent image to develop the electrostatic latent image into a visible toner image, and transferring and fusing the visible toner image onto the recording medium.

A developing device supplies the toner to the electrostatic latent image that is formed on the surface of the photosensitive body to develop the electrostatic latent image into the visible toner image. The electrophotographic image forming apparatus includes the developing device, which includes a developing agent. Toner that is supplied from a toner container to the developing device passes through a development roller and is supplied to the photosensitive body. In the developing device, the toner that is supplied from the toner container and toner that is stored in the developing device have to circulate and be sequentially used for a developing process. If the toner that is stored in the developing device does not smoothly circulate, new toner may not be effectively supplied into the developing device. Also, if toner in a specific region of the developing device is continuously pressed without circulating, stress applied to the toner is increased, thereby degrading physical properties of the toner and increasing a driving torque of the developing device. Also, toner packing that is a phenomenon where toner lumps are formed in the specific region of the developing device may occur.

SUMMARY

One or more example embodiments include a developing device in which toner may smoothly circulate and an image forming apparatus including the developing device.

Additional aspects will be set forth in part in the description which follows and will be apparent from the description, or may be learned by practice of the presented example embodiments.

According to one or more example embodiments, a developing device includes: a photosensitive body on which an electrostatic latent image is formed; a development chamber; a development roller that faces the photosensitive body and transfers toner to the electrostatic latent image; a supply roller that supplies toner in the development chamber to the development roller; and an agitating member that is disposed under the supply roller in the development chamber and agitates the toner that is in the development chamber.

The agitating member may reciprocate in a direction perpendicular to a longitudinal axis of the development roller.

The developing device may further include a rotation member disposed in the development chamber and including an eccentric shaft that is eccentric with respect to a central axis about which the rotation member rotates, wherein the agitating member is connected to the eccentric shaft. The agitating member may include a connecting portion that is connected to the eccentric shaft and an agitating plate that extends from the connecting portion in the longitudinal direction and a radial direction, wherein the agitating plate includes a plurality of through-slots.

The agitating member may include an agitating blade, is provided in the development chamber, and rotates.

The developing device may include a guide member that divides the development chamber into an upper area and a lower area, extends toward the supply roller while at least partially surrounding a lower portion of the supply roller, wherein the agitating member includes an opening through which the upper area and the lower area communicate with each other. The agitating member may be disposed under the guide member.

The developing device may further include a toner supply unit that supplies toner to the development chamber by conveying the toner in a longitudinal direction that is an axial direction of the development roller, wherein the toner supply unit is disposed above the supply roller.

The toner supply unit may include: a supply portion comprising a supply member for conveying toner in a first direction and a supply hole for supplying toner to the development chamber; a retrieving portion disposed above the supply portion and comprising a retrieval member for conveying toner in a second direction that is opposite to the first direction; and a partition wall that separates the supply portion from the retrieving portion and includes first and second communication holes that are formed in two end portions of the partition wall in the longitudinal direction and through which the supply portion and the retrieving portion communicate with each other.

At least a part of a projection area of the supply hole in a gravity direction may overlap the supply roller.

According to one or more example embodiments, an electrophotographic image forming apparatus includes the developing device.

The electrophotographic image forming apparatus may further include a toner container that is connected to the development chamber and supplies toner to the development chamber.

BRIEF DESCRIPTION OF THE DRAWINGS

These and other aspects will become apparent and more readily appreciated from the following description of the example embodiments, taken in conjunction with the accompanying drawings in which.

DETAILED DESCRIPTION

Reference will now be made in detail to example embodiments, examples of which are illustrated in the accompanying drawings.

Figure 1:
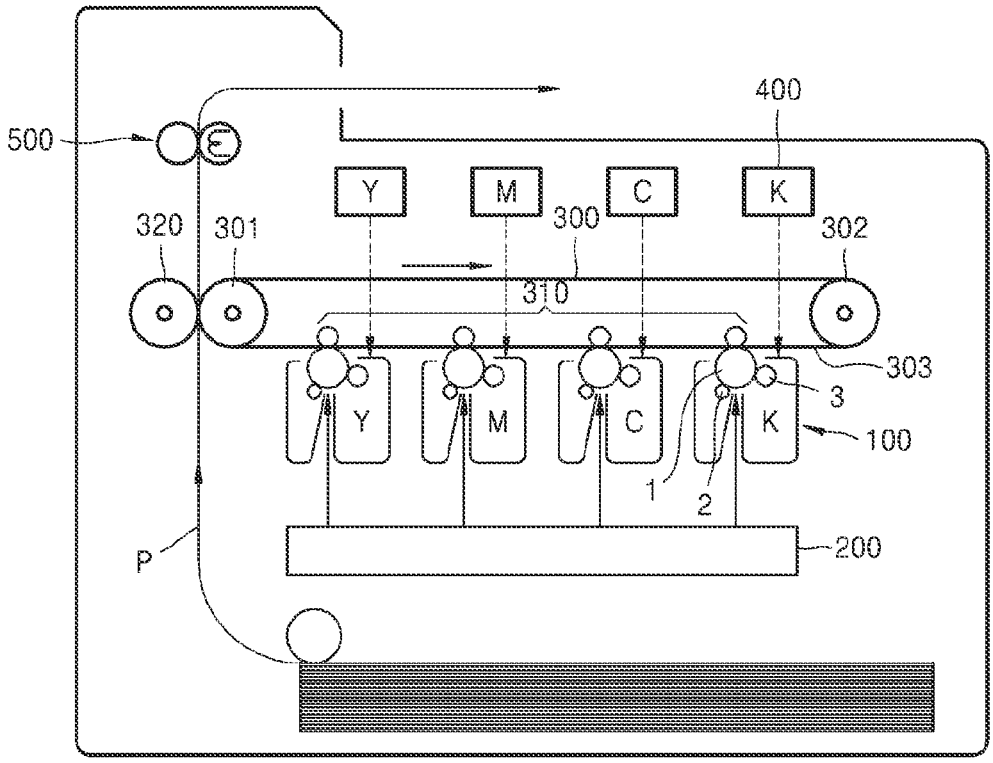
FIG. 1 is a view illustrating a configuration of an image forming apparatus, according to an example embodiment.

FIG. 1 is a view illustrating a configuration of an image forming apparatus, according to an example embodiment. The image forming apparatus of the present example embodiment is an electrophotographic color image forming apparatus that forms a color image by using four developing devices 100 in which cyan (C) toner, magenta (M) toner, yellow (Y) toner, and black (K) toner are contained. Members that are used to form C, M, Y, and K images are respectively denoted by reference numerals with subscripts C, M, Y, and K.

Referring to FIG. 1, an intermediate transfer belt 300, an exposure unit 200, the four developing devices 100, four intermediate transfer rollers 310, a final transfer roller 320, and a fuser unit 500 are illustrated.

The intermediate transfer belt 300 is an intermediate transfer medium which is supported by support rollers 301 and 302 and circulates. A toner image is temporarily transferred to the intermediate transfer belt 300 before being finally transferred to a recording medium P.

Each of the four developing devices 100 includes a charge roller 2, a photosensitive drum 1, and a development roller 3. The photosensitive drum 1 is a photosensitive body on which an electrostatic latent image is formed. The photosensitive drum 1 may be obtained by forming a photosensitive layer having photoconductivity on an outer circumferential surface of a cylindrical metal pipe. The charge roller 2 is a charger for charging a surface of the photosensitive drum 1 to a uniform potential. A corona charger, instead of the charge roller 2, may be used.

The exposure unit 200 forms the electrostatic latent image by emitting light that is modulated to correspond to image information to the photosensitive drum 1. A light-emitting diode (LED) exposure unit that selectively turns on according to the image information a plurality of LEDs that are arranged in a main scanning direction may be used as the exposure unit 200. Also, a laser scanning unit (LSU) that deflects a light emitted from a laser diode by using a light deflector such that the deflected light travels in the main scanning direction and scans the deflected light toward the photosensitive drum 1 may be used as the exposure unit 200. The development roller 3 forms a toner image by attaching toner that is contained in the developing device 100 to the electrostatic latent image that is formed on the photosensitive drum 1. Toner may be contained in the developing device 100 and may be supplied from a toner container 400 to the developing device 100. When the toner that is contained in the toner container 400 is completely consumed, the toner container 400 may be replaced with a new one, independent of the developing device 100.

Each of the four developing devices 100 is disposed such that the photosensitive drum 1 faces a bottom surface 303 of the intermediate transfer belt 300. The photosensitive drum 1 may contact the bottom surface 303 of the intermediate transfer belt 300. The intermediate transfer roller 310 is an intermediate transfer unit for transferring the toner image that is formed on the photosensitive drum 1 to the intermediate transfer belt 300. The four intermediate transfer rollers 310 are disposed respectively above the four photosensitive drums 1 with the bottom surface 303 of the intermediate transfer belt 300 therebetween. An intermediate transfer bias voltage for transferring the toner image that is formed on the photosensitive drum 1 to the intermediate transfer belt 300 may be applied to each of the four intermediate transfer rollers 310. A corona transfer unit, instead of the intermediate transfer roller 310, may be used.

The final transfer roller 320 is a final transfer unit for transferring the toner image from the intermediate transfer belt 300 to the recording medium P. A final transfer bias voltage for transferring the toner image from the intermediate transfer belt 300 to the recording medium P may be applied to the final transfer roller 320. A corona transfer unit, instead of the final transfer roller 320, may be used. The fuser unit 500 fuses the toner image that is transferred to the recording medium P by applying heat and pressure to the toner image.

A method of forming a color image in the afore-described configuration will now be briefly explained.

First, the exposure unit 200 forms an electrostatic latent image by emitting light toward the photosensitive drum 1K that is charged to a uniform potential by the charge roller 2K, according to black (K) image information. When a development bias voltage is applied to the development roller 3K of the developing device 100K, black toner that is contained in the developing device 100K is attached to the electrostatic latent image. A black toner image that is developed on the photosensitive drum 1K is transferred to the intermediate transfer belt 300 due to an intermediate transfer bias voltage that is applied to the intermediate transfer roller 310K. By using the same processes, cyan, magenta, and yellow toner images are transferred to the intermediate transfer belt 300 and a color toner image is formed on the intermediate transfer belt 300. The color toner image is transferred to the recording medium P due to a final transfer bias voltage that is applied to the final transfer roller 320, and is fused on the recording medium P by the fuser unit 500.

Figure 2:
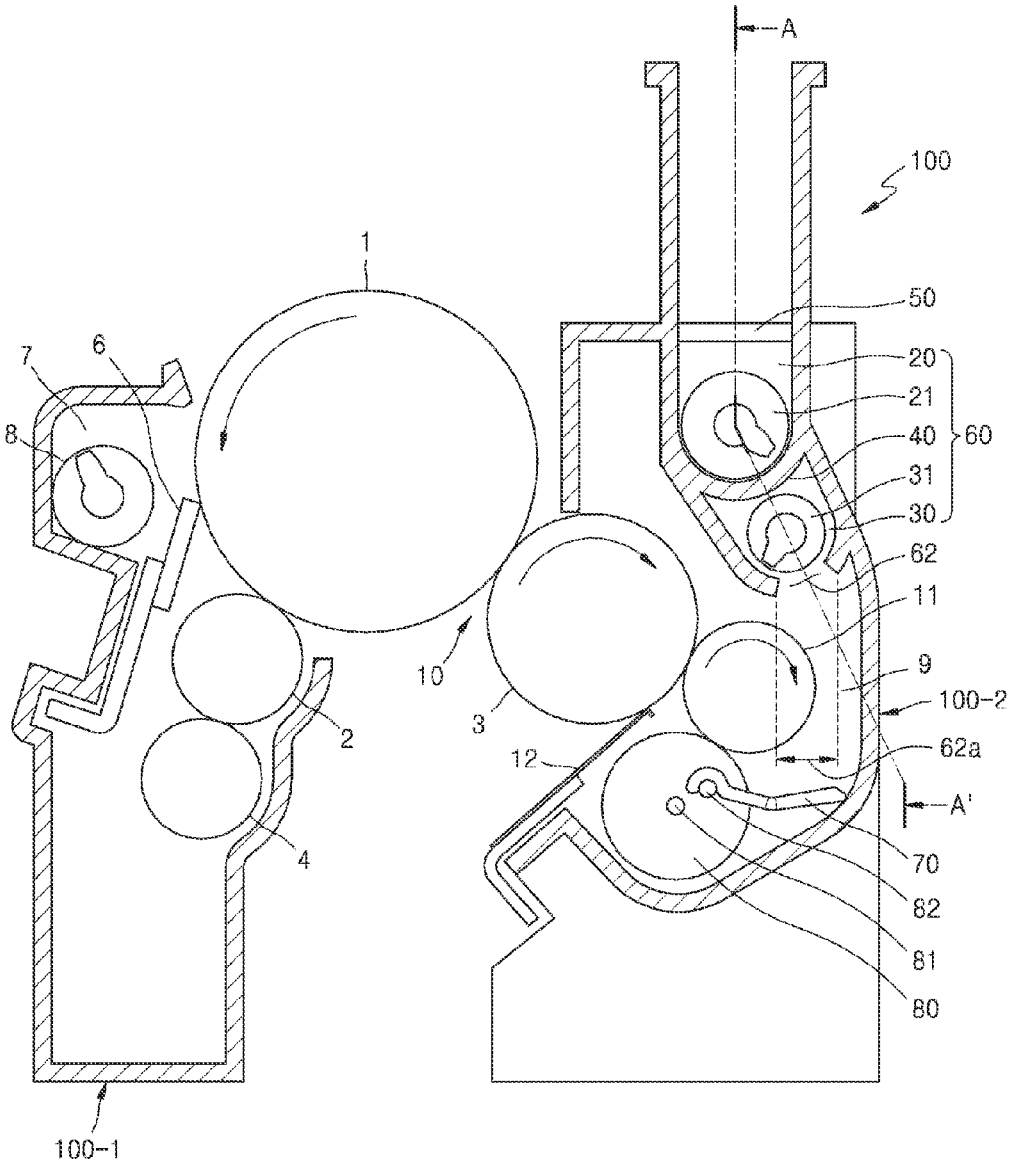
FIG. 2 is a view illustrating a configuration of a developing device that is included in the image forming apparatus of FIG. 1, according to an example embodiment.

FIG. 2 is a view illustrating a configuration of the developing device 100 that is included in the image forming apparatus of FIG. 1, according to an example embodiment. Referring to FIG. 2, the developing device 100 includes a photosensitive unit 100-1 and a development unit 100-2.

The photosensitive unit 100-1 includes the photosensitive drum 1 and the charge roller 2. A cleaning roller 4 contacts the charge roller 2, and rotates and removes a foreign material that is attached to a surface of the charge roller 2. A cleaning blade 6 removes residual toner that remains on a surface of the photosensitive drum 1 after a transferring process. The removed residual toner is referred to as waste toner. The waste toner may be stored in a waste toner receiving space 7 in the photosensitive unit 100-1, and may be conveyed to a waste toner container (not shown) by a waste toner conveying member 8.

The development unit 100-2 includes a development chamber 9, and the development roller 3 that carries toner that is contained in the development chamber 9 to a development area 10 where the development roller 3 and the photosensitive drum 1 face each other. A supply roller 11 contacts the development roller 3 and rotates. A supply bias voltage is applied to the supply roller 11, and a development bias voltage is applied to the development roller 3. A supply electric field is formed between the supply roller 11 and the development roller 3 due to the supply bias voltage and the development bias voltage. As the supply roller 11 rotates, toner that is carried to the development roller 3 by the supply roller 11 is attached to a surface of the development roller 3 due to the supply electric field.

A regulation member 12 that regulates the amount of toner attached to the surface of the development roller 3 is disposed downstream of the supply roller 11 in a direction in which the development roller 3 rotates. For example, the regulation member 12 may be a blade that elastically contacts the surface of the development roller 3. A toner layer having a uniform thickness is formed on the surface of the development roller 3 due to the regulation member 12. Toner is charged due to friction between the development roller 3 and the regulation member 12. A bias voltage for charging the toner may be applied to the regulation member 12.

As the development roller 3 rotates, the toner on the surface of the development roller 3 is carried to the development area 10 where the development roller 3 and the photosensitive drum 1 face each other. A development electric field is formed in the development area 10 due to the development bias voltage. The toner is moved from the surface of the development roller 3 to the surface of the photosensitive drum 1 and is attached to the surface of the photosensitive drum 1 due to the development electric field. Accordingly, an electrostatic latent image that is formed on the surface of the photosensitive drum 1 is developed and thus a visible toner image is produced.

Toner is supplied from the toner container 400 to the development unit 100-2. A toner supply unit 60 that receives the toner from the toner container 400 and supplies the toner to the development chamber 9 is provided in the development unit 100-2. In order to naturally supply the toner from the toner container 60 to the development chamber 9 due to gravity, the toner supply unit 60 is disposed above the development chamber 9. Also, in order to supply fresh toner from the toner supply unit 60 to the supply roller 11, the toner supply unit 60 is disposed above the supply roller 11.

Figure 3:
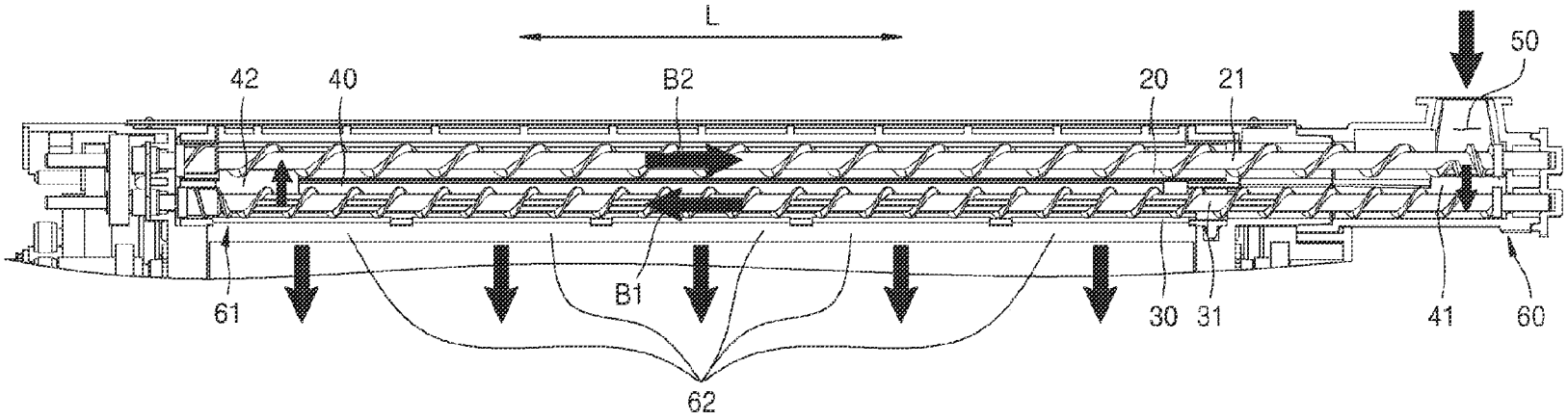
FIG. 3 is a cross-sectional view taken along line A-A' of FIG. 2, according to an example embodiment.

FIG. 3 is a cross-sectional view taken along line A-A' of FIG. 2, according to an example embodiment. Referring to FIGS. 2 and 3, the toner supply unit 60 extends in a longitudinal direction L. The longitudinal direction L is a width direction of the recording medium P, that is, an axial direction of the development roller 3 and the supply roller 11. The toner supply unit 60 includes a toner inlet portion 50, a supply portion 30, and a retrieving portion 20. The retrieving portion 20 is disposed above the supply portion 30. The supply portion 30 is disposed above the supply roller 11.

The supply portion 30 and the retrieving portion 20 are separated from each other by a partition wall 40 that extends in the longitudinal direction L. A first communication hole 41 is formed in one end portion of the partition wall 40 in the longitudinal direction L. Also, a second communication hole 42 is formed in the other end portion of the partition wall 40 in the longitudinal direction L. The supply portion 30 and the retrieving portion 20 are connected to each other through the first and second communication holes 41 and 42. The toner inlet portion 50 is disposed near one end portion of each of the supply portion 30 and the retrieving portion 20 in the longitudinal direction L, that is near the first communication hole 41.

A supply member 31 that agitates toner and conveys the toner in a first direction B1, that is, from the first communication hole 41 to the second communication hole 42, is disposed in the supply portion 30. The supply member 31 may include, for example, an auger including a spiral wing. A retrieval member 21 that conveys toner in a second direction B2, that is, from the second communication hole 42 to the first communication hole 41, is disposed in the retrieving portion 20. The retrieval member 21 may include, for example, an auger including a spiral wing.

Toner that is supplied from the toner container 400 to the toner inlet portion 50 is conveyed in the first direction B1 along the supply portion 30 by the supply member 31. Supply holes 62 are formed in a bottom surface of a housing 61 that defines the supply portion 30. The toner that is conveyed in the first direction B1 along the supply portion 30 drops into the development chamber 9 through the supply holes 62. The toner may directly drop onto the supply roller 11. That is, at least a part of a projection area 62*a* of each of the supply holes 62 in a gravity direction overlaps the supply roller 11. Accordingly, fresh toner may be effectively supplied through the supply roller 11 to the development roller 3.

When toner that is conveyed along the supply portion 30 reaches around the second communication hole 42, the toner is pushed by a feed force of the supply member 31 to be introduced through the second communication hole 42 into the retrieving portion 20. The retrieval member 21 conveys the toner that is introduced through the second communication hole 42 in the second direction B2. When the toner reaches the first communication hole 41, the toner naturally drops into the supply portion 30 due to its weight. In this case, new toner that is supplied from the toner container 400 is mixed with toner that circulates in the toner supply unit 60. In this configuration, toner circulates in the toner supply unit 60 and is supplied to the development chamber 9.

Toner is naturally supplied from the toner supply unit 60 to the development chamber 9 due to gravity. Once the development chamber 9 is filled with toner, toner is no longer supplied from the toner supply unit 60 to the development chamber 9, and toner remaining in the toner supply unit 60 circulates in the supply portion 30 and the retrieving portion 20.

Figure 4:
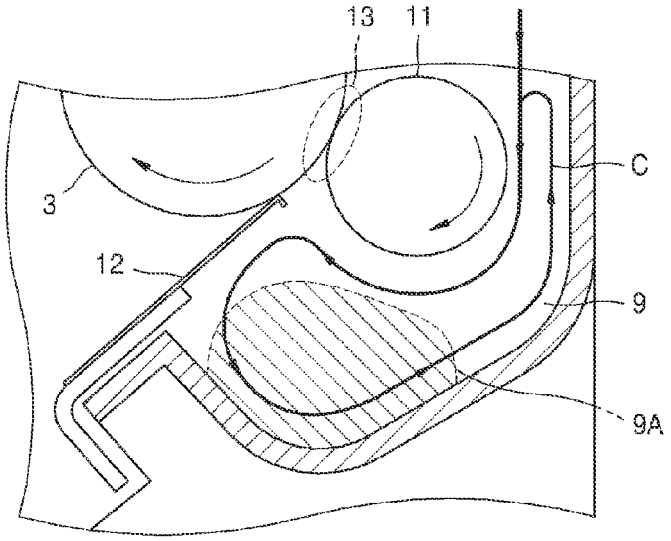
FIG. 4 is an illustration explaining how toner circulates in a development chamber.

FIG. 4 is a view illustrating how toner circulates in a development chamber 9. Referring to FIG. 4, as the supply roller 11 rotates, a portion of the toner that is supplied from the toner supply unit 60 into the development chamber 9 is conveyed to a supply area 13 where the development roller 3 and the supply roller 11 face each other. A portion of the toner is attached to the development roller 3 due to an electric field that is formed between the development roller 3 and the supply roller 11. The remainder of the toner, which is not attached to the development roller 3 in the supply area 13, drops into the development chamber 9 due to the weight thereof. The regulation member 12 regulates a toner layer on a surface of the development roller 3. Accordingly, any excess toner attached to the development roller 3 is removed from the surface of the development roller 3 by the regulation member 12 and drops into the development chamber 9. The toner that drops into the development chamber 9 accumulates in a lower portion 9A of the development chamber 9 under the supply roller 11. Once the development chamber 9 is filled with the toner, the toner is conveyed to the toner supply unit 60 in a direction marked by an arrow C of FIG. 4 and then is mixed with new toner that is supplied from the toner supply unit 60 and repeatedly circulates as described above.

When toner continuously accumulates in the lower portion 9A under the supply roller 11, pressure applied to the toner in the lower portion 9A increases. Accordingly, the amount of toner that is supplied from the toner supply unit 60 to the lower portion 9A is much greater than the amount of toner that is moved upward from the lower portion 9A to the tonner supply unit 60, and the toner is continuously compressed in the lower portion 9A, thereby leading to toner packing.

When the toner does not circulate in the lower portion 9A, the toner in the lower portion 9A stays in the development chamber 9 until the end of a lifespan of the developing device 100, and only toner that is supplied from the toner supply unit 60 to a space around the supply roller 11 is continuously attached through the development area 10 to the photosensitive drum 1 to be developed. Also, as toner having a smaller diameter and a shape closer to a spherical shape tends to be more easily developed, at the end of the lifespan of the developing device 100, only toner having a large diameter and a poor spherical shape remains in the development chamber 9. Since the toner having a large diameter and a poor spherical shape has poor development performance, the quality of an image that is formed at the end of the lifespan of the developing device 100 may be worse than that of an image that is formed at the beginning of the lifespan of the developing device 100. Also, when the toner in the lower portion 9A does not circulate, the toner is continuously compressed due to gravity and a toner feed force that is produced as the supply roller 11 rotates, thereby leading to toner packing that is a phenomenon where toner lumps are formed. Once the toner packing occurs, rolling resistance is applied to the supply roller 11 and the development roller 3 that rotate in the development chamber 9, thereby increasing a driving torque.

Referring to FIG. 2, the developing device 100 of the present example embodiment includes an agitating member 70 that is disposed in the lower portion 9A of the development chamber 9 and agitates toner in order to prevent the toner from staying. The agitating member 70 causes the toner to flow in the development chamber 9. The agitating member 70 agitates the toner in the development chamber 9 in a direction that crosses the longitudinal direction L.

Figure 5:
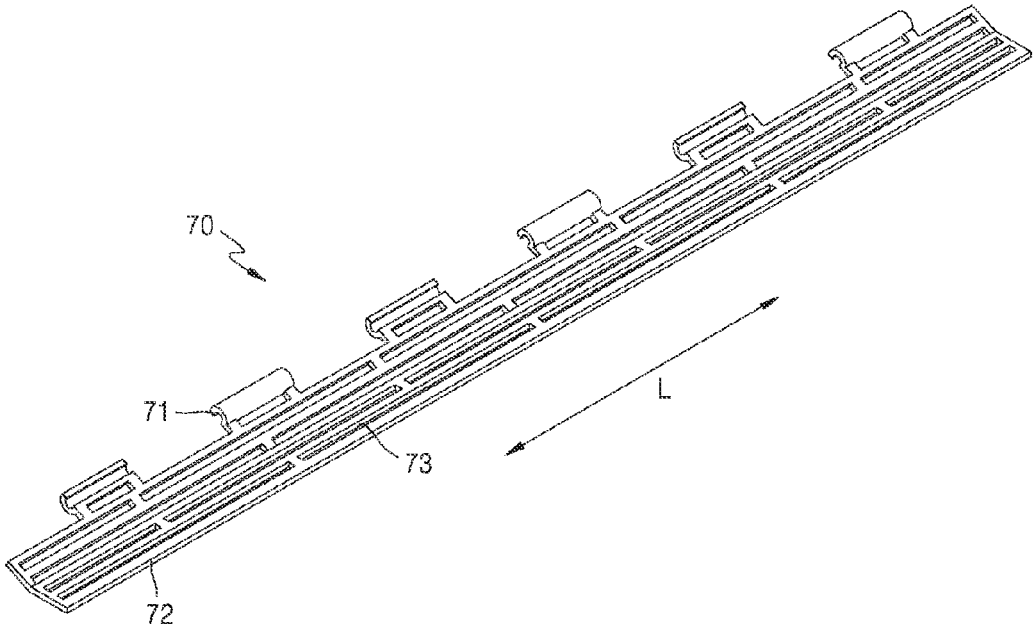
FIG. 5 is a perspective illustrating an agitating member according to an example embodiment.
Figure 6:
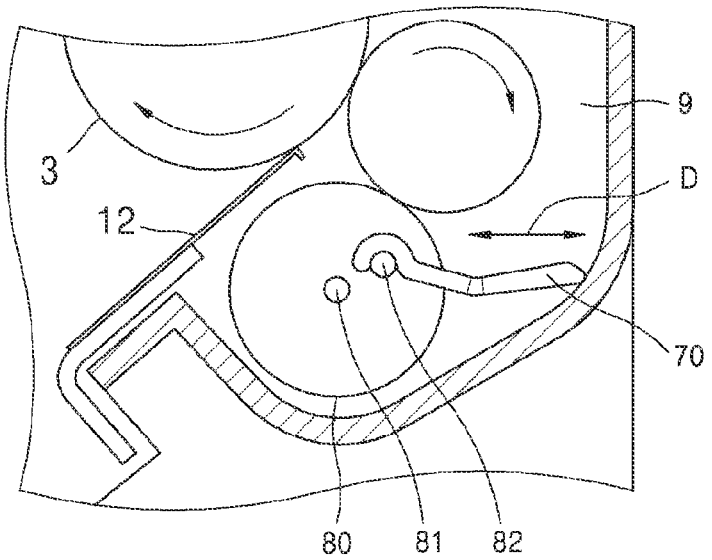
FIG. 6 is a cross-sectional view illustrating an operation of the agitating member of FIG. 5, according to an example embodiment.

FIG. 5 is a perspective view illustrating the agitating member 70 according to an example embodiment. FIG. 6 is a cross-sectional view for explaining an operation of the agitating member 70 of FIG. 5, according to an example embodiment. Referring to FIGS. 2, 4, 5, and 6, the agitating member 70 reciprocates toner in the lower portion 9A in a direction D that is perpendicular to the longitudinal direction L. To this end, a rotation member 80 is provided in the development chamber 9. The agitating member 70 is connected to an eccentric shaft 82 that is eccentric from a central axis 81 of the rotation member 80. When the rotation member 80 rotates, the agitating member 70 reciprocates in the direction D that is perpendicular to the longitudinal direction L. The agitating member 70 may include a connecting portion 71 that is connected to the eccentric shaft 82 of the rotation member 80 and an agitating plate 72 that extends in the longitudinal direction L and a radial direction from the connecting portion 71. A plurality of through-slots 73 may be formed in the agitating plate 72. Due to the slots 73, the agitating member 70 may more efficiently agitate toner and thus cause the toner to flow.

When the toner begins to flow due to the reciprocation of the agitating member 70, toner lumps may be prevented from forming in the lower portion 9A. Accordingly, the toner naturally circulates in the development chamber 9 in the direction marked by the arrow C of FIG. 4 due to a toner feed force that is produced due to the rotation of the supply roller 11.

In this configuration, new toner whose amount corresponds to the amount of toner that circulates in the development chamber 9 and is attached to the photosensitive drum 1 to be developed is supplied from the toner supply unit 60 to the development chamber 9. Accordingly, toner may be continuously mixed with new toner in the development chamber 9. Also, since a constant toner pressure is maintained in the development chamber 9 without excessively increasing, stress applied to toner is also reduced. Accordingly, physical properties of toner are stably maintained uniform until the end of the lifespan of the developing device 100 and a printed image having stable quality may be obtained until the end of the lifespan of the developing device 100. Also, since toner packing does not occur, a driving torque of the developing device 100 may be maintained at a stable level until the end of the lifespan of the developing device 100.

Although the agitating member 70 that reciprocates in the direction D that is perpendicular to the longitudinal direction L is used in the above example embodiments, the inventive concept is not limited thereto. Any of various agitating members that may cause toner to flow by agitating the toner in the development chamber 9 may be used.

Figure 7:
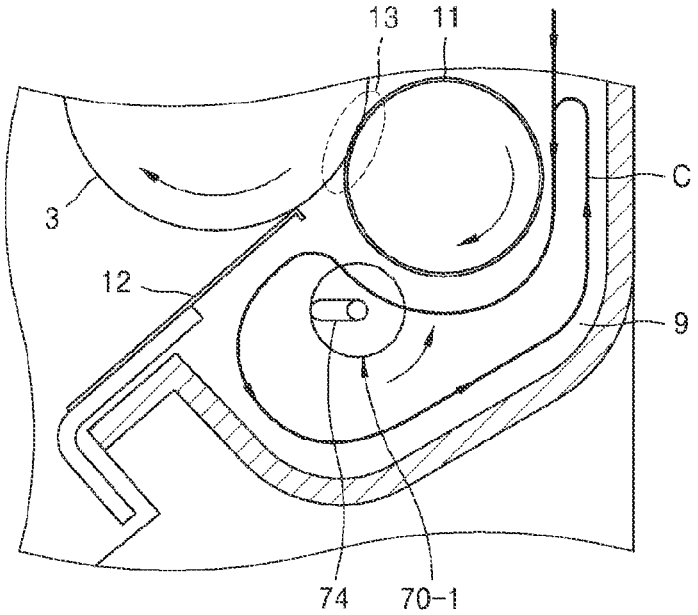
FIG. 7 is a cross-sectional view illustrating a development unit according to an example embodiment.
Figure 8:
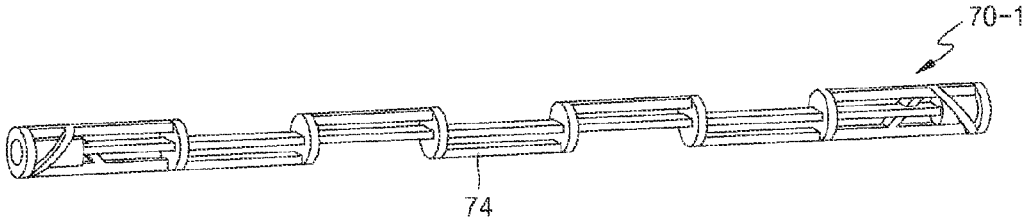
FIG. 8 is a perspective view illustrating an agitating member applied to the development unit of FIG. 7, according to an example embodiment.

FIG. 7 is a cross-sectional view illustrating the development unit 100-2 according to an example embodiment. FIG. 8 is a perspective view illustrating an agitating member 70-1 applied to the development unit 100-2 of FIG. 7, according to an example embodiment. Referring to FIGS. 7 and 8, the agitating member 70-1 that rotates is disposed in the lower portion 9A of the development chamber 9 under the supply roller 11. The agitating member 70-1 that is disposed under the supply roller 11 and extends in the longitudinal direction L to be parallel to the supply roller 11 includes an agitating blade 74 that extends in the radial direction. The agitating member 70-1 is disposed under the supply area 13 where the development roller 4 and the supply roller 11 face each other. When the agitating member 70-1 rotates, the agitating blade 74 agitates toner in the development chamber 9 and thus causes the toner to flow in the development chamber 9. The toner may circulate in the development chamber 9 in a direction marked by an arrow C. A direction in which the agitating member 70-1 rotates may be opposite to a direction in which the supply roller 11 rotates. Accordingly, the toner may be more easily conveyed to the toner supply unit 60.

A position of the agitating member 70-1 is not limited to that in FIG. 7. The agitating member 70-1 may be disposed at any position in the development chamber 9, as long as the agitating member 70-1 is disposed under the supply roller 11

Figure 9:
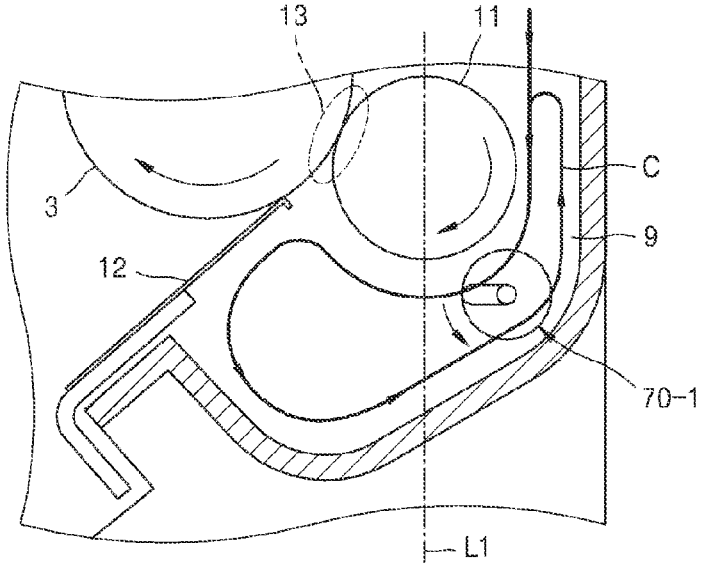
FIG. 9 is a cross-sectional view illustrating the development unit according to another example embodiment.

FIG. 9 is a cross-sectional view illustrating the development unit 100-2 according to another example embodiment. Referring to FIG. 9, the agitating member 70-1 is disposed under the supply roller 11 so that the agitating member 70-1 and the supply area 13 are on opposite sides of a vertical line L1 that passes through the center of the supply roller 11. Even in this configuration, since toner in the development chamber 9 flows due to rotation of the agitating member 70-1, the toner may circulate in the development chamber 9 in the direction marked by the arrow C. A direction in which the agitating member 70-1 rotates may be opposite to a direction in which the supply roller 11 rotates.

Figure 10:
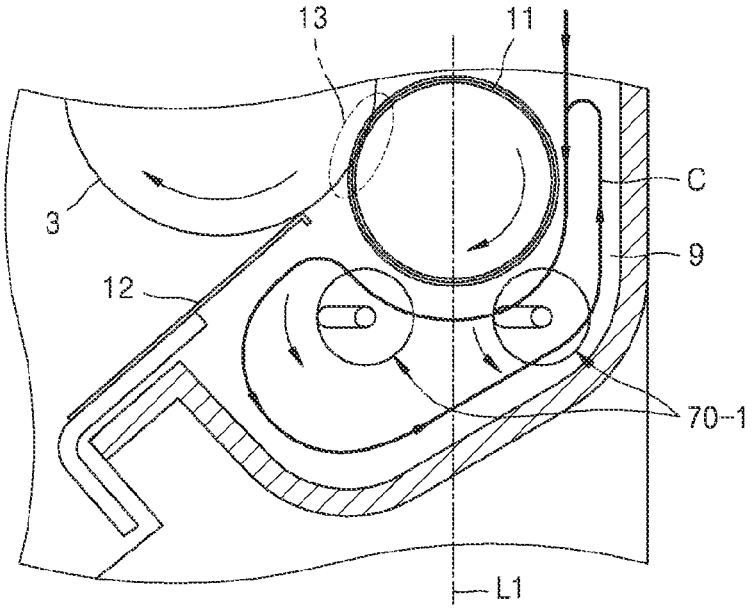
FIG. 10 is a cross-sectional view illustrating the development unit according to another example embodiment.

A plurality of the agitating members 70-1 may be disposed. FIG. 10 is a cross-sectional view illustrating the development unit 100-2 according to another example embodiment. Referring to FIG. 10, the agitating members 70-1 are disposed under the supply roller 11 in the development chamber 9 to be located on both sides of the straight line L1 that passes through the center of the supply roller 11. A direction in which the agitating members 70-1 rotate may be opposite to a direction in which the supply roller 11 rotates.

Figure 11:
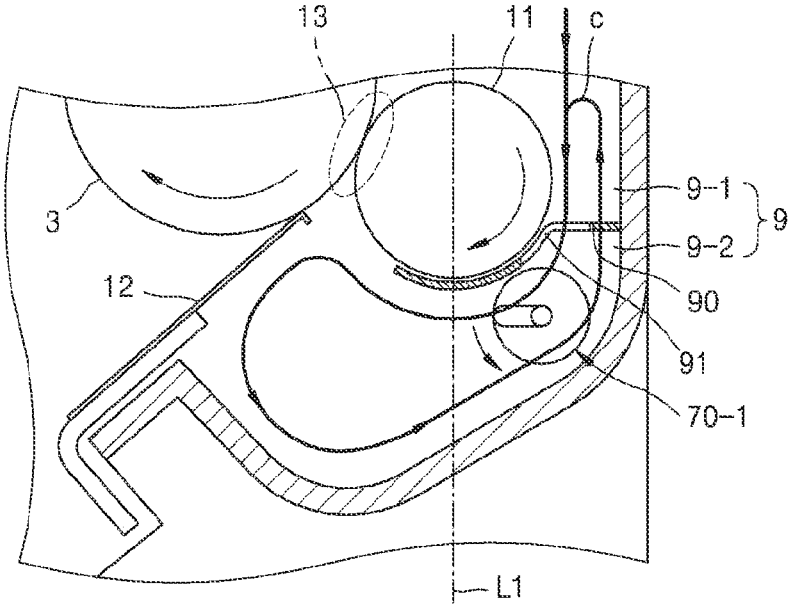
FIG. 11 is a cross-sectional view illustrating the development unit according to another example embodiment.

FIG. 11 is a cross-sectional view illustrating the development unit 100-2 according to another example embodiment. Referring to FIG. 11, a guide member 90 is disposed between the agitating member 70-1 and the supply roller 11. The guide member 90 divides the development chamber 9 into a lower area 9-2 and an upper area 9-1 with respect to the supply roller 11 and extends toward the supply area 13 while at least partially surrounding a lower portion of the supply roller 11. An opening 91 through which toner in the lower area 9-2 is conveyed to the upper area 9-1 is formed in the guide member 90. In this configuration, a supply force of the supply roller 11 that conveys toner to the supply area 13 may be increased. When toner around the supply roller 11 is conveyed to the supply area 13 due to rotation of the supply roller 11, a strong supply force of the supply roller 11 is applied to a gap between the guide member 90 and the supply roller 11. Accordingly, toner that is supplied from the upper area 9-1 may be effectively conveyed to the supply area 13 without being mixed with toner in the lower area 9-2. The toner in the lower area 9-2 is conveyed to the upper area 9-1 through the opening 91 as the agitating member 70-1 rotates.

Figure 12:
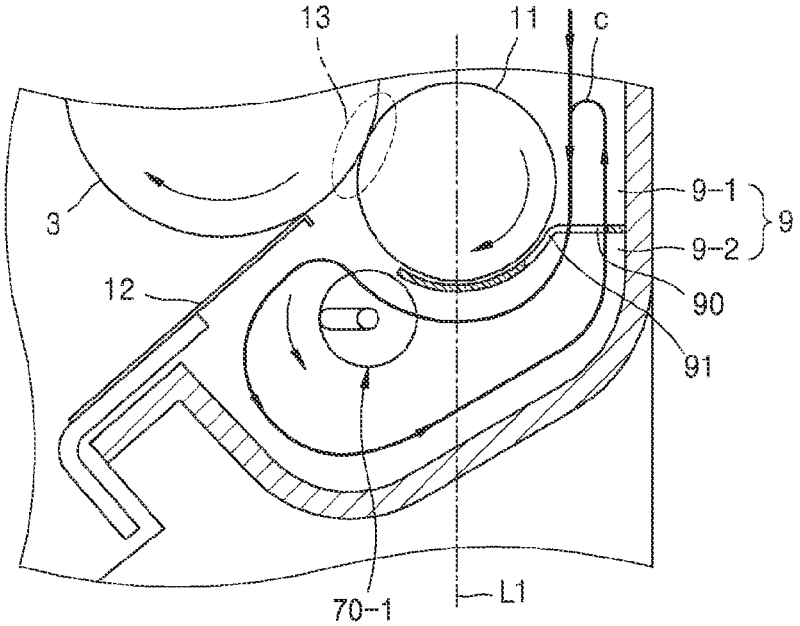
FIG. 12 is a cross-sectional view illustrating the development unit according to another example embodiment.

The guide member 90 may be applied to the development unit 100-2 of FIG. 7. FIG. 12 is a cross-sectional view illustrating the development unit 100-2 according to another example embodiment. Referring to FIG. 12, the agitating member 70-1 is disposed under the supply area 13 where the development roller 3 and the supply roller 11 face each other. The guide member 90 is disposed between the agitating member 70-1 and the supply roller 11. The guide member 90 divides the development chamber 9 into the lower area 9-2 and the upper area 9-1 with respect to the supply roller 11 and extends to the supply area 13 while at least partially surrounding a lower portion of the supply roller 11. The opening 91 through which toner in the lower area 9-2 is conveyed to the upper area 9-1 is formed in the guide member 90.

Figure 13:
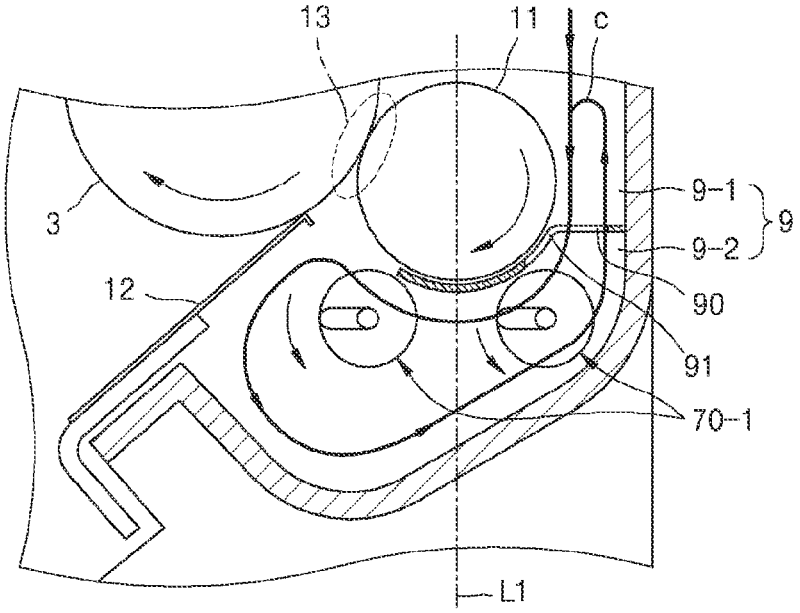
FIG. 13 is a cross-sectional view illustrating the development unit according to another example embodiment.

The guide member 90 may be applied to the development unit 100-2 of FIG. 10. FIG. 13 is a cross-sectional view illustrating the development unit 100-2 according to another example embodiment. Referring to FIG. 13, the agitating members 70-1 are disposed under the supply roller 11 in the development chamber 9 to be located on both sides of the vertical line L1 that passes through the center of the supply roller 11.

The guide member 90 is disposed between the agitating members 70-1 and the supply roller 11 to divide the development chamber 9 into the lower area 9-2 and the upper area 9-1 with respect to the supply roller 11 and to extend to the supply area 13 and overlap a lower portion of the supply roller 11. The opening 91 through which toner in the lower portion 9-2 is conveyed to the upper area 9-1 is formed in the guide member 90.

Although not shown in FIG. 13, the guide member 90 may be applied to the development chamber 9 that includes the reciprocating type agitating member 70 of FIG. 2 that reciprocates.

Although a color image forming apparatus has been explained in the above example embodiments, the inventive concept is not limited thereto. The inventive concept may be applied to a monochromatic image forming apparatus that includes one developing device 100 and transfers to the recording medium P a visible toner image that is formed on the photosensitive drum 1.

While the inventive concept has been particularly shown and described with reference to example embodiments thereof, it will be understood by those of ordinary skill in the art that various changes in form and details may be made therein without departing from the spirit and scope of the inventive concept as defined by the following claims.

What is claimed is:

1. A developing device comprising:

a photosensitive body on which an electrostatic latent image is formed;

a development chamber;

a development roller that faces the photosensitive body and transfers toner to the electrostatic latent image;

a supply roller that supplies toner in the development chamber to the development roller;

an agitating member disposed under the supply roller in the development chamber, said agitating member being arranged to agitate the toner that is in the development chamber; and a toner supply unit that supplies the toner to the development chamber by conveying the toner in a longitudinal direction that is an axial direction of the development roller, wherein the toner supply unit is disposed above the supply roller, the toner supply unit comprises a supply hole through which the toner conveyed in the longitudinal direction drops into the development chamber, and at least a part of a projection of the supply hole in a gravity direction overlaps the supply roller.

2. The developing device of claim 1, wherein the agitating member arranged to reciprocate in a direction perpendicular to a longitudinal axis of the development roller.

3. The developing device of claim 2, further comprising:

a rotation member disposed in the development chamber, said rotation member comprising an eccentric shaft that is eccentric with respect to a central axis about which the rotation member rotates, wherein the agitating member is connected to the eccentric shaft.

4. The developing device of claim 3, wherein the agitating member comprises a connecting portion that is connected to the eccentric shaft and an agitating plate that extends from the connecting portion in the longitudinal direction and in a radial direction, wherein the agitating plate comprises a plurality of through-slots.

5. The developing device of claim 1, wherein the agitating member comprises an agitating blade provided in the development chamber, said agitating member being arranged to rotate.

6. The developing device of claim 1, further comprising a guide member that divides the development chamber into an upper area and a lower area, said guide member extending toward the supply roller and at least partially surrounding a lower portion of the supply roller, wherein the guide member includes an opening through which the upper area and the lower area communicate with each other.

7. The developing device of claim 6, wherein the agitating member is disposed under the guide member.

8. A developing device comprising:

a photosensitive body on which an electrostatic latent image is formed;

a development chamber;

a development roller that faces the photosensitive body and transfers toner to the electrostatic latent image;

a supply roller that supplies toner in the development chamber to the development roller;

an agitating member disposed under the supply roller in the development chamber, said agitating member being arranged to agitate the toner that is in the development chamber;

a toner supply unit that supplies toner to the development chamber by conveying the toner in a longitudinal direction that is an axial direction of the development roller, wherein the toner supply unit is disposed above the supply roller; and wherein the toner supply unit comprises:

a supply portion comprising a supply member for conveying toner in a first direction and a supply hole for supplying toner to the development chamber;

a retrieving portion disposed above the supply portion and comprising a retrieval member for conveying toner in a second direction that is opposite to the first direction; and a partition wall that separates the supply portion from the retrieving portion and includes first and second communication holes that are formed in first and second end portions respectively of the partition wall in the longitudinal direction and through which the supply portion and the retrieving portion communicate with each other.

9. The developing device of claim 8, wherein at least a part of a projection of the supply hole in a gravity direction overlaps the supply roller.

10. An electrophotographic image forming apparatus comprising a developing device, wherein the developing device comprises:

a photosensitive body on which an electrostatic latent image is formed;

a development chamber;

a development roller that faces the photosensitive body and transfers toner to the electrostatic latent image;

a supply roller that supplies toner in the development chamber to the development roller;

an agitating member disposed under the supply roller in the development chamber, said agitating member being arranged to agitate the toner that is in the development chamber; and a toner supply unit that supplies toner to the development chamber by conveying the toner in a longitudinal direction that is an axial direction of the development roller, wherein the toner supply unit is disposed above the supply roller, the toner supply unit comprises a supply hole through which the toner conveyed in the longitudinal direction drops into the development chamber, and at least a part of a proiection of the supply hole in a gravity direction overlaps the supply roller.

11. The electrophotographic image forming apparatus of claim 10, wherein the agitating member is arranged to reciprocate in a direction perpendicular to a longitudinal axis of the development roller.

12. The electrophotographic image forming apparatus of claim 11, further comprising:

a rotation member disposed in the development chamber, said rotation member comprising an eccentric shaft that is eccentric with respect to a central axis about which the rotation member rotates, wherein the agitating member is connected to the eccentric shaft.

13. The electrophotographic image forming apparatus of claim 12, wherein the agitating member comprises a connecting portion that is connected to the eccentric shaft and an agitating plate that extends from the connecting portion in the longitudinal direction and in a radial direction, wherein the agitating plate comprises a plurality of through-slots.

14. The electrophotographic image forming apparatus of claim 10, wherein the agitating member comprises an agitating blade provided in the development chamber, said agitating member being arranged to rotate.

15. The electrophotographic image forming apparatus of claim 10, further comprising a guide member that divides the development chamber into an upper area and a lower area, said guide member extending toward the supply roller and at least partially surrounding a lower portion of the supply roller, wherein the guide member includes an opening through which the upper area and the lower area communicate with each other.

16. The electrophotographic image forming apparatus of claim 10, further comprising a toner container that is connected to the development chamber via the toner supply unit and supplies toner to the development chamber.

17. An electrophotographic image forming apparatus comprising a developing device, wherein the developing device comprises:

a photosensitive body on which an electrostatic latent image is formed;

a development chamber;

a development roller that faces the photosensitive body and transfers toner to the electrostatic latent image;

a supply roller that supplies toner in the development chamber to the development roller;

an agitating member disposed under the supply roller in the development chamber, said agitating member being arranged to agitate the toner that is in the development chamber;

a toner supply unit that supplies toner to the development chamber by conveying the toner in a longitudinal direction that is an axial direction of the development roller, wherein the toner supply unit is disposed above the supply roller; and wherein the toner supply unit comprises:

a supply portion comprising a supply member for conveying toner in a first direction and a supply hole for supplying toner to the development chamber;

a retrieving portion disposed above the supply portion and comprising a retrieval member for conveying toner in a second direction that is opposite to the first direction; and a partition wall that separates the supply portion from the retrieving portion, and includes first and second communication holes that are formed in first and second end portions respectively of the partition wall in the longitudinal direction and through which the supply portion and the retrieving portion communicate with each other.

18. The electrophotographic image forming apparatus of claim 17, wherein at least a part of a projection of the supply hole overlaps the supply roller.

* * * * *